US008342799B2

(12) United States Patent
Hwang et al.

(10) Patent No.: US 8,342,799 B2
(45) Date of Patent: Jan. 1, 2013

(54) CENTRIFUGAL FAN

(75) Inventors: Ching-Bai Hwang, Taipei Hsien (TW); Zhi-Hui Zhao, Shenzhen (CN); Wen-Jie Zhang, Shenzhen (CN)

(73) Assignees: Fu Zhun Precision Industry (Shen Zhen) Co., Ltd, Shenzhen (CN); Foxconn Technology Co., Ltd., New Taipei (TW)

( * ) Notice: Subject to any disclaimer, the term of this patent is extended or adjusted under 35 U.S.C. 154(b) by 1413 days.

(21) Appl. No.: 11/959,314

(22) Filed: Dec. 18, 2007

(65) Prior Publication Data

US 2009/0142179 A1 Jun. 4, 2009

(30) Foreign Application Priority Data

Nov. 30, 2007 (CN) ..... 2007 1 0077457 A

(51) Int. Cl.
*F04D 29/40* (2006.01)

(52) U.S. Cl. ..... 415/185; 415/206

(58) Field of Classification Search ..... 361/695; 415/178, 15, 189, 206, 214.118, 185, 214.1
See application file for complete search history.

(56) References Cited

U.S. PATENT DOCUMENTS

| | | | | |
|---|---|---|---|---|
| 3,231,176 | A * | 1/1966 | Bowen | 417/350 |
| 6,604,906 | B2 * | 8/2003 | Ozeki et al. | 415/204 |
| 7,163,371 | B2 | 1/2007 | Higashida | |
| 7,165,938 | B2 * | 1/2007 | Lee et al. | 415/206 |
| 7,207,774 | B2 * | 4/2007 | Kashiwazaki et al. | 415/206 |
| 7,267,526 | B2 | 9/2007 | Hsu et al. | |
| 7,329,100 | B2 * | 2/2008 | Kashiwazaki et al. | 416/182 |
| 7,591,633 | B2 * | 9/2009 | Hancock | 415/206 |
| 2004/0253101 | A1 * | 12/2004 | Hancock | 415/213.1 |
| 2006/0222491 | A1 * | 10/2006 | Shimada | 415/206 |
| 2007/0201976 | A1 * | 8/2007 | Higashida | 415/206 |
| 2007/0222331 | A1 * | 9/2007 | Horng et al. | 310/268 |

FOREIGN PATENT DOCUMENTS

CN 200420002811.7 5/2005

* cited by examiner

*Primary Examiner* — Richard Edgar
*Assistant Examiner* — Sean J Younger
(74) *Attorney, Agent, or Firm* — Altis Law Group, Inc.

(57) ABSTRACT

A centrifugal fan includes a fan frame (20), and a stator (30) and a rotor (40) received in the fan frame. The fan frame includes a bottom base (22), an opposite top cover (21) and a side wall (23) interconnecting the bottom base and the top cover. A first air inlet (24*a*) is defined in the top cover and a second air inlet (24*b*) is defined in the bottom base. The rotor includes a hub (41) and a plurality of blades (42) extending from an outer periphery of the hub. An air flow channel (48) is formed between an outer periphery of the blades and the side wall of the fan frame. A cylindrical wall (26, 26*a*) is formed around one of the first air inlet and the second air inlet to guide airflow from the first and second air inlets into the air flow channel and block the airflow in the air flow channel from flowing back towards the first and second air inlets.

16 Claims, 5 Drawing Sheets

CENTRIFUGAL FAN

BACKGROUND OF THE INVENTION

1. Field of the Invention

The present invention relates generally to fans, and more particularly to a centrifugal fan which has low noise and can generate a high air pressure and a large mount of airflow during operation.

2. Description of Related Art

With the fast development of the electronics industry, electronic components such as CPUs (central processing units), or VGA (video graphics array) are being made with ever faster operating speeds. During operation of the electronic components, a large amount of heat is generated. Greater emphasis is now being laid on increasing the efficiency and effectiveness of heat dissipation devices so as to keep operational temperature of the electronic components within a suitable range, and a centrifugal fan is generally used to provide a forced airflow to increase heat dissipation.

The centrifugal fan typically includes a housing, a hub and a plurality of blades extending radially from the hub and received in the housing. A first air inlet and a second air inlet are defined in central portions of top and bottom surfaces of the housing respectively, and an air outlet is defined in a side wall of the housing and is oriented perpendicularly to the air inlets.

The diameters of the first and second air inlets are equal to each other and are both smaller than the diameter of the fan blades. For avoiding interference between the fan blades and the housing, a clearance must be defined between each of the top and bottom surfaces of the housing and the fan blades. In use, the fan blades rotate to engender an airflow, and the airflow is intaked from the air inlets and is guided into an interior of the centrifugal fan to form a high pressure airflow, which is then discharged towards the electronic component via the air outlet, thus cooling the electronic component continuously. However, the high pressure airflow in the centrifugal fan also impinges on the side wall of the fan and is rebounded back, tending to flow back into the air inlets via the clearances defined between the housing and the blades, which conflicts with the requirement of the fan blades to fully make use of the airflow, thus impairing performance of the centrifugal fan. Additionally, when the airflow intaked from the air inlets mixes with the rebounded airflow, a vortex is formed around the air inlets, which not only reduces the mount of airflow flowing into the housing of the fan but also increases the noise.

For the foregoing reasons, therefore, it is desired to devise a centrifugal fan which can overcome the above-mentioned problems.

SUMMARY OF THE INVENTION

The present invention relates to a centrifugal fan. According to a preferred embodiment of the present invention, the centrifugal fan includes a fan frame, and a stator and a rotor received in the fan frame. The fan frame includes a bottom base, an opposite top cover and a side wall interconnecting the bottom base and the top cover. A first air inlet is defined in the top cover and a second air inlet is defined in the bottom base. The rotor includes a hub and a plurality of blades extending from an outer periphery of the hub. An air flow channel is formed between an outer periphery the blades and the side wall of the fan frame. A cylindrical wall is formed around one of the first air inlet and the second air inlet to guide airflow from the first and second air inlets into the air flow channel and block the airflow in the air flow channel from flowing back towards the first and second air inlets.

The present invention in another aspect, relates to a centrifugal fan which includes a bottom base, an opposite top cover, and a side wall interconnecting the bottom base with the top cover. An air inlet is defined in a central portion of the bottom base. An air out let defined in the sidewall is perpendicular to the air inlet. A space for receiving a rotor is defined by the bottom base, the top cover and the side wall cooperatively. A cylindrical wall extends from an inner periphery of the air inlet into the space. When the rotor rotates, ambient air is inhaled from the air inlet into said space and leaves said space from the air outlet. The cylindrical wall is adapted for guiding the ambient air from the air inlet into said space and blocking interior air in said space from flowing back towards the air inlet.

Other advantages and novel features of the present invention will become more apparent from the following detailed description of preferred embodiment when taken in conjunction with the accompanying drawings, in which:

DETAILED DESCRIPTION OF THE INVENTION

Figure 1:
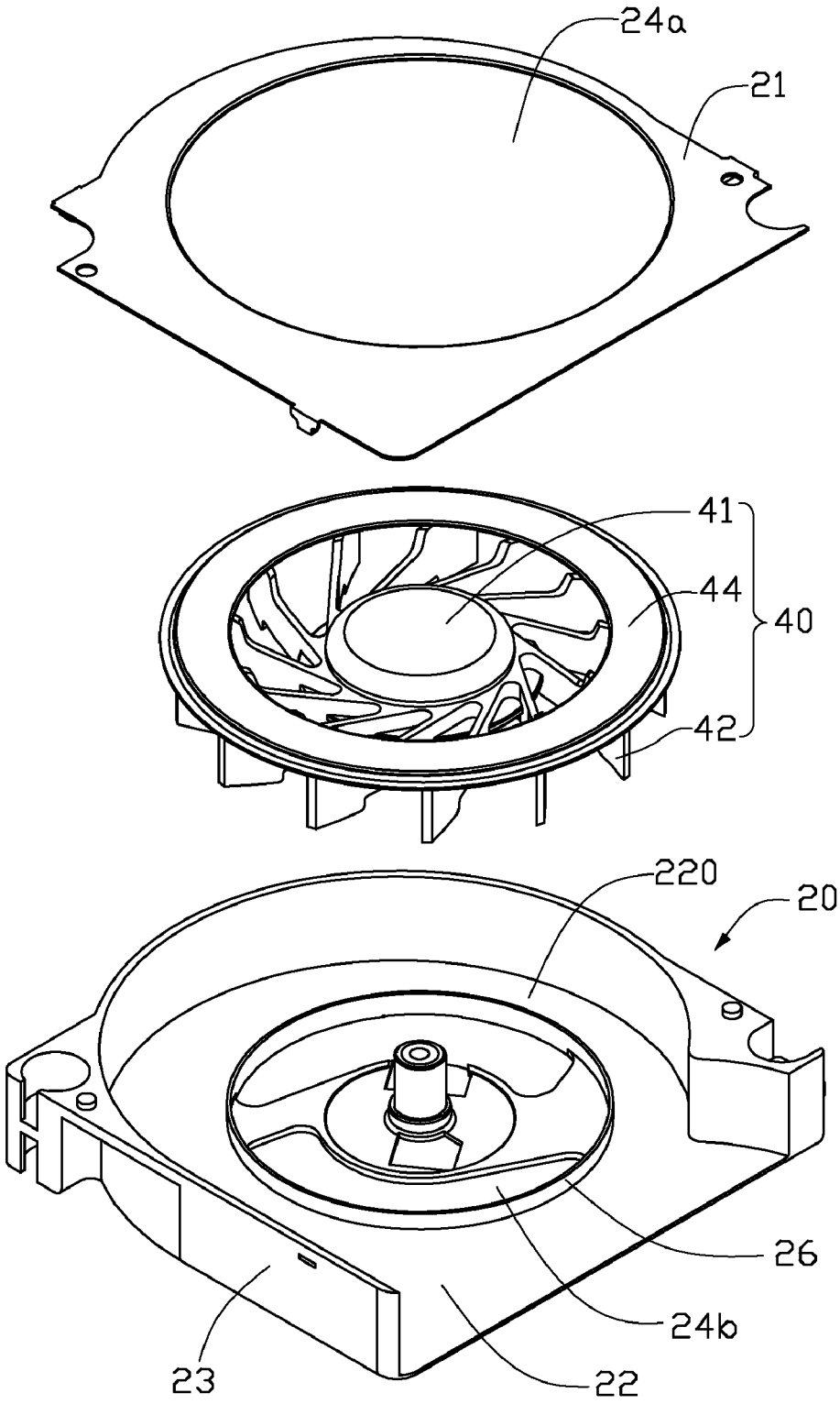
FIG. 1 is an exploded, isometric view of a centrifugal fan in accordance with a first embodiment of the present invention.
Figure 2:
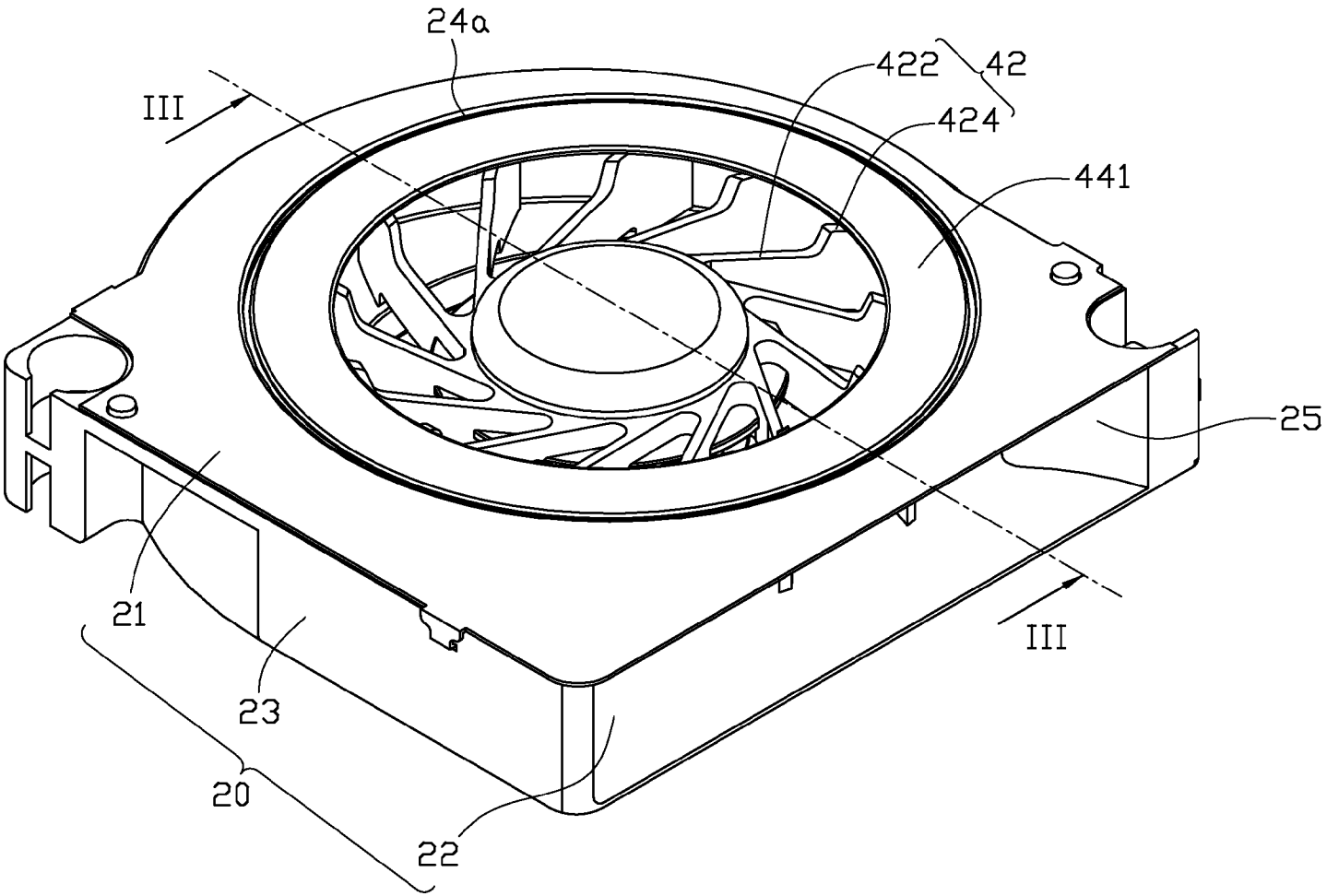
FIG. 2 is an assembled, isometric view of the centrifugal fan of FIG. 1.
Figure 3:
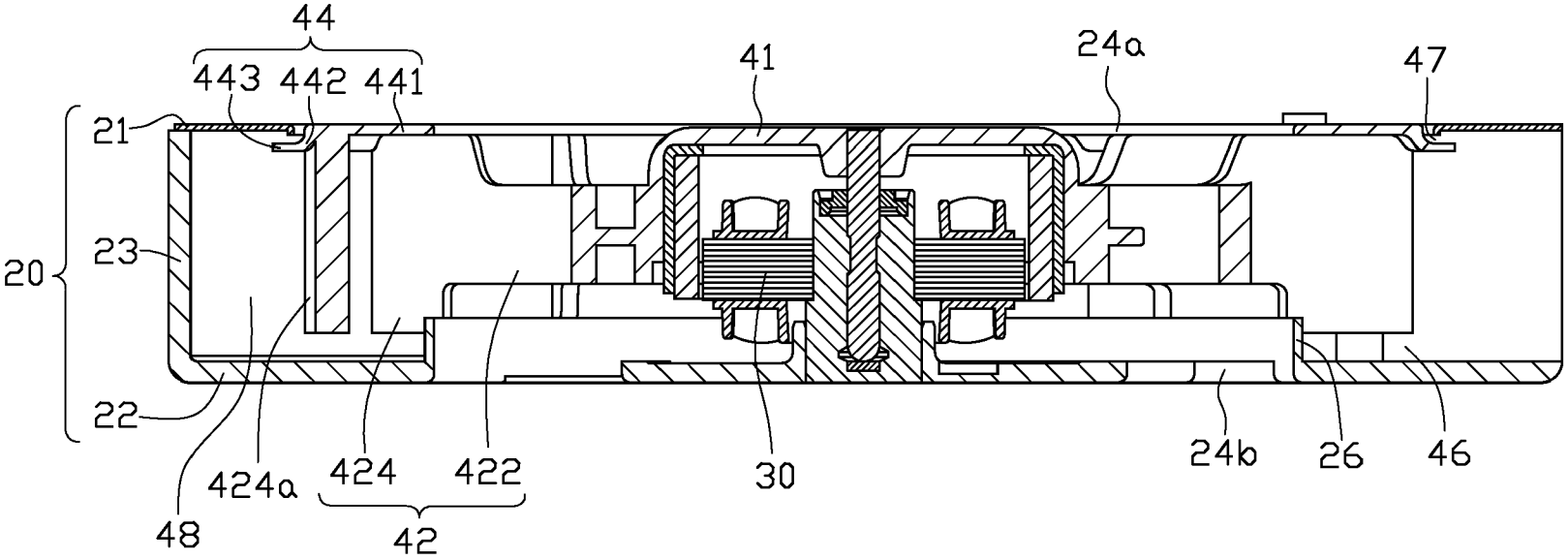
FIG. 3 is a cross-sectional view of the centrifugal fan, along line III-III from FIG. 2 to show an inner structure thereof.

Referring to FIGS. 1-3, a centrifugal fan according to a first embodiment of the present invention is shown. The centrifugal fan includes a fan frame 20 and a stator 30 and a rotor 40 contained in the fan frame 20.

The fan frame 20 includes a top cover 21, a bottom base 22 paralleled to the top cover 21 and a side wall 23 interconnecting the top cover 21 and the bottom base 22. The side wall 23 and the bottom base 22 are integrally formed as a monolithic piece by injection molding. The top cover 21, the bottom base 22 and the side wall 23 cooperatively define an inner space (not labeled) for receiving the stator 30 and the rotor 40 therein. A first air inlet 24*a* is defined in a central portion of the top cover 21 and a second air inlet 24*b* is defined in a central portion of the bottom base 22, a diameter of the first air inlet 24*a* being lager than that of the second air inlet 24*b*. An air outlet 25 is defined in one side of the side wall 23 of the fan frame 20 and is oriented perpendicularly to the first and second air inlets 24*a*, 24*b*. An cylindrical wall 26 extends perpendicularly and upwardly from an inner periphery of the second air inlet 24*b* of the bottom base 22 into the inner space of the fan frame 20. A diameter of the cylindrical wall 26 basically equals to that of the second air inlet 24*b*. The cylindrical wall 26 is disposed around the second air inlet 24*b* for guiding an ambient airflow that is inhaled from the second air inlet 24*b* into an interior of the centrifugal fan. A vertical height of the cylindrical wall 26 is preferred between 1.5 millimeters and 2.2 millimeters. Thus, the cylindrical wall 26 can guide the airflow to flow into the interior of the centrifugal fan perpendicularly relative to the bottom base 22 of the fan frame 20.

The rotor 40 is driven by the stator of the centrifugal fan to be rotatable with respect to the stator 30 in the fan frame 20. The rotor 40 includes a hub 41, a plurality of blades 42 extending radially and outwardly from an outer periphery of the hub 41 and a blade ring 44 fixedly mounted on a top surface of the blades 42. Each of the blades 42 includes a first blade portion 422 connected with the hub 41 and a second blade portion 424 extending from a distal end of the first blade portion 422. A vertical height of the second blade portion 424 is larger than that of the first blade portion 422. The cylindrical wall 26 is located at a position corresponding to a joint between the first blade portion 422 and the second blade portion 424. A bottom face of the first blade portion 422 spaces a distance from the cylindrical wall 26 so that the first blade portion 422 does not interferes with the cylindrical wall 26. The second blade portion 424 is received between the cylindrical wall 26 and the side wall 23 of the fan frame 20. Thus, the vertical height of second blade portion 424 is not limited by the cylindrical wall 26, and only an axial clearance 46 of about 1.0 millimeter is needed between a bottom face of the second blade portion 424 and the bottom base 22 of the fan frame 20 to avoid contact and interference between the blades 42 and the fan frame 20 during operation of the centrifugal fan. In the fan frame 20, an air flow channel 48 is formed between outmost free ends of the blades 42 and the side wall 23 of the fan frame 20, and the air flow channel 46 communicates with the air outlet 25.

The blade ring 44 and the blades 42 are integrally formed by injection molding process as a single piece. The blade ring 44 includes an annular, planar connecting wall 441, a cylindrical sidewall 442 extending perpendicularly and downwardly from an outer periphery of the connecting wall 441, and a flange 443 extending outwardly and radially from a bottom of the sidewall 442. An inner diameter of the connecting wall 441 is approximately the same as the diameter of the second air inlet 24*b*, and an outer diameter of the connecting wall 441 is a little smaller than that of the first air inlet 24*a*. The blade ring 44 is received in the first air inlet 24*a* of the top cover 21 of the centrifugal fan, and a top surface of the connecting wall 441 of the blade ring 44 is coplanar with a top surface of the top cover 21 of the centrifugal fan. The second blade portions 424 are located under the connecting wall 441 of the blade ring 44, and the blades 42 do not extend under the top cover 21 of the fan frame 20. Accordingly, the second blade portions 424 can extend upwardly up to the connecting wall 441 of the blade ring 44. Since the connecting wall 441 of the blade ring 44 and the top cover 21 of the fan frame 20 are coplanar with each other, the vertical height of the second blade portion 424 is increased as compared with prior arts. The sidewall 442 of the blade ring 44 surrounds a top edge portion of an outmost vertical edge 424*a* of each of the blades 42. A radial clearance is formed between the sidewall 442 of the blade ring 44 and the top cover 21 of the frame 20, to avoid contact and interference therebetween as the rotor 40 rotates relative to the top cover 21 of the centrifugal fan. The flange 443 of the blade ring 44 is located directly under and overlaps with the top cover 21 of the fan frame 20. The flange 443 is parallel to and is spaced another axial clearance 47 of about 1.0 millimeter from the top cover 21 to avoid contact and interference therebetween during operation of the centrifugal fan.

During operation, the blade ring 44 rotates together with the blades 42 as the rotor 40 rotates, the airflow generated by the rotor 40 is intaked from the first and second air inlets 24*a*, 24*b* into the fan frame 20. After entering into the fan frame 20, the airflow turns into a high-pressure airflow and accumulates in the air flow channel 48. The high-pressure airflow is then discharged from the air flow channel 48 into an exterior of the fan frame 20 at a high pressure via the air outlet 25. Generally, a portion of the high-pressure airflow will rebound back after impinging on the sidewall 23 of the fan frame 20 and tends to reflux towards the first and second air inlets 24*a*, 24*b*, via the axial clearances 46, 47 which are respectively formed between the bottom face of the blade 42 and the bottom base 22 of the fan frame 20, and between the flange 443 of the blade ring 44 and the top cover 21 of the fan frame 20. Air turbulence will be generated between the airflow currently being intaked from the first and second air inlets 24*a*, 24*b* and the refluxed airflow, thereby causing large air noise and energy loss. Due to the presence of the cylindrical wall 26 formed around the second air inlet 24*b* and located between the blades 42 and the bottom base 22 of the fan frame 20, the refluxed airflow is blocked by the cylindrical wall 26 to flow back into the second air inlet 24*b*. Furthermore, the cylindrical sidewall 442 of the blade ring 44 is located around the first air inlet 24*a*, the refluxed airflow is also blocked by the sidewall 442 of the blade ring 44 to flow back into the first air inlet 24*a*. As a result, the cylindrical wall 26 of the bottom base 21 and the cylindrical sidewall 442 of the blade ring 44 cooperatively reduce air turbulence caused by the refluxed airflow so that noise generated by the air turbulence is greatly reduced, and stop air leakage from the first and second air inlets 24*a*, 24*b* so that the airflow pressure and the volume of the airflow can be greatly increased.

Figure 4:
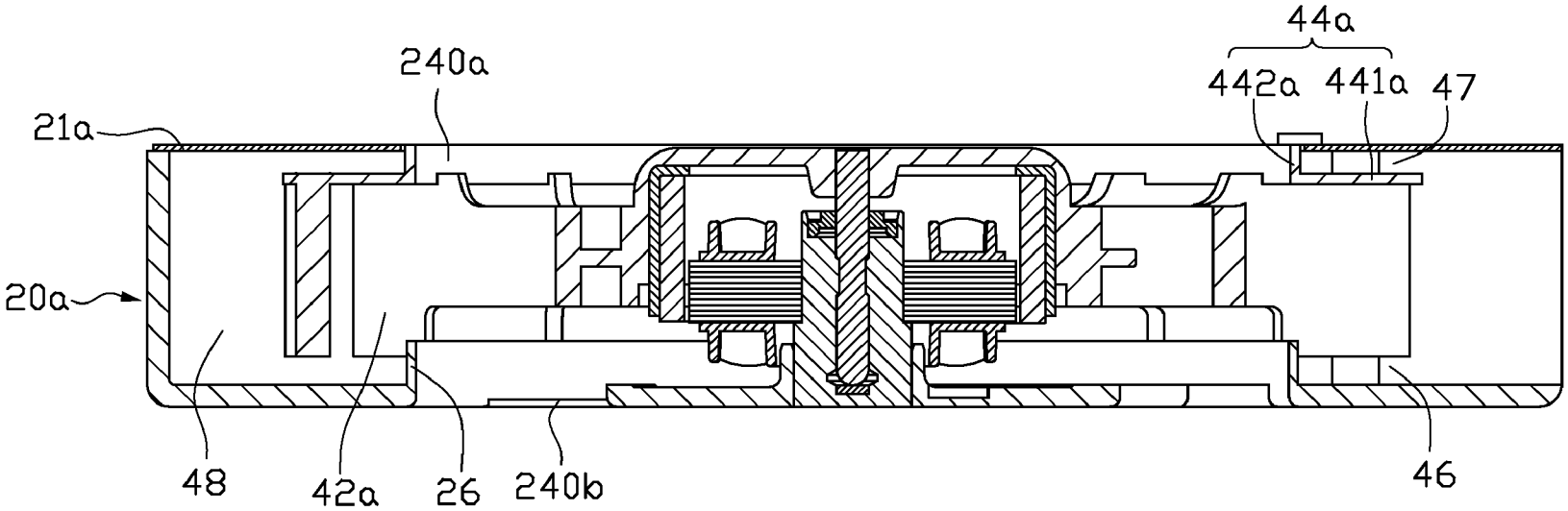
FIG. 4 is a cross-sectional view of a centrifugal fan according to a second embodiment of the present invention.

FIG. 4 shows a second embodiment of the centrifugal fan. Except for the structure of the blade ring 44*a* and the size of the first air inlet 240*a*, other parts of the centrifugal fan in accordance with this second embodiment have substantially the same configurations as the centrifugal fan of the previous first embodiment. More specifically, the blade ring 44*a* includes an annular, planar connecting wall 441*a* and a cylindrical sidewall 442*a* extending perpendicularly and upwardly from an inner periphery of the connecting wall 441*a*. A diameter of the first air inlet 240*a* is approximately the same as that of the second air inlet 240*b*. The connecting wall 441*a* of the blade ring 44*a* is located just under the top cover 21*a* of the fan frame 20*a* to form the axial clearance 47 therebetween, and the sidewall 442*a* of the blade ring 44*a* extends upwardly from the inner periphery of the connecting wall 441*a* and is received in the first air inlet 240*a* of the centrifugal fan. A top surface of the sidewall 442*a* of the blade ring 44*a* is located in a same horizontal level with a top surface of the top cover 21*a*. The sidewall 442*a* is disposed near a periphery of the first air inlet 240*a*. During operation, the sidewall 442*a* of the blade ring 44*a* also functions to block refluxed airflow to flow back into the first air inlet 240 and reduce air turbulence caused by the refluxed airflow. Thus, the airflow generated by the blades 42*a* can constantly and stably flow into the interior of the centrifugal fan due to the guidance of the cylindrical sidewall 442*a* of the blade ring 44*a*, and noise generated by the air turbulence is greatly reduced and the airflow pressure and volume of the airflow is increased.

Figure 5:
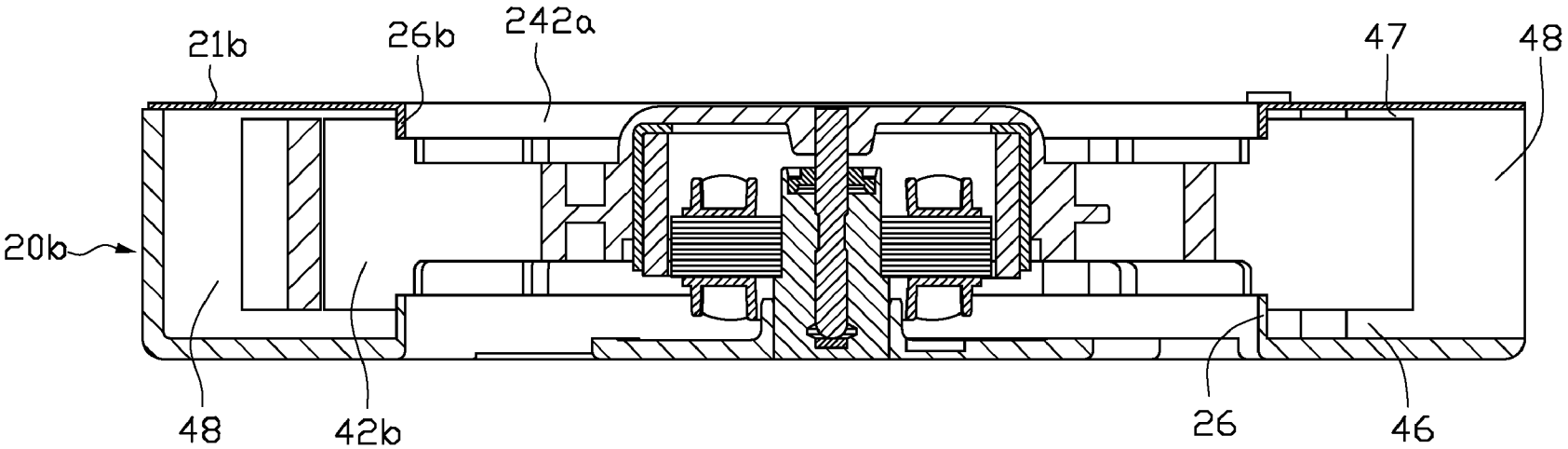
FIG. 5 is a cross-sectional view of a centrifugal fan according to a third embodiment of the present invention.

FIG. 5 shows a third embodiment of the centrifugal fan. The configuration of the centrifugal fan in accordance with this third embodiment is substantially the same as the centrifugal fan of the previous second embodiment, except that a second cylindrical wall 26*b* is formed in the first air inlet 242*a* of the top cover 21*b* and no blade ring 44*a* is used. The second cylindrical wall 26*a* extends downwardly and perpendicularly from an inner periphery of the first air inlet 242*a* of the top cover 21*b* of the fan frame 20*b*. The axial clearance 47 is formed between a top surface of the blade 42*b* and the top cover 21*b* of the fan frame 20*b*, a function of the second cylindrical wall 26*a* is substantially the same as that of the cylindrical wall 26 of the bottom base 22 as shown in the previous second embodiment, i.e., blocking refluxed airflow to flow back into the first air inlet 242*a* and reducing air turbulence caused by the refluxed airflow.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A centrifugal fan, comprising:

a fan frame comprising a bottom base, an opposite top cover and a side wall interconnecting the bottom base and the top cover, a first air inlet defined in the top cover of the fan frame and a second air inlet defined in the bottom base of the fan frame;

a stator received in the fan frame;

a rotor driven by the stator to be rotatable in the fan frame, the rotor comprising a hub and a plurality of blades extending from an outer periphery of the hub, an air flow channel being formed between an outer periphery of the blades and the side wall of the fan frame; and at least one cylindrical wall formed around one of the first air inlet and the second air inlet and extending into the fan frame, the at least one cylindrical wall guiding airflow from one of the first and second air inlets into the air flow channel of the fan frame and blocking the airflow in the air flow channel from flowing back towards one of the first and second air inlets;

wherein the at least one cylindrical wall extends from an inner periphery of the second air inlet of the bottom base, and the rotor further comprises a blade ring arranged on top faces of the blades and received in the first air inlet of the top cover, the blade ring comprising an annular, planar connecting wall, a cylindrical sidewall extending downwardly from an outer periphery of the connecting wall and located near an inner periphery of the first air inlet, and a flange extending outwardly from a bottom of the sidewall and located under the top cover, the connecting wall of the blade ring is received in the first air inlet of the top cover, a top surface of the connecting wall of the blade ring being coplanar with a top surface of the top cover, wherein the sidewall blocks the airflow in the air flow channel from flowing back towards the first air inlet.

2. The centrifugal fan as described in claim 1, wherein the at least one cylindrical wall has two in number, one of the cylindrical walls extending from an inner periphery of the first air inlet of the top cover and the other one of the cylindrical walls extending from an inner periphery of the second air inlet of the bottom base.

3. The centrifugal fan as described in claim 1, wherein a diameter of the first air inlet of the top cover is larger than that of the second air inlet of the bottom base.

4. The centrifugal fan as described in claim 3, wherein an inner diameter of the connecting wall is approximately the same as the diameter of the second air inlet of the bottom base, and an outer diameter of the connecting wall is a little smaller than that of the first air inlet of the top cover.

5. The centrifugal fan as described in claim 1, wherein the at least one cylindrical wall extends from an inner periphery of the second air inlet of the bottom base, and the rotor further comprises a blade ring arranged on top faces of the blades, the blade ring comprising an annular, planar connecting wall and a cylindrical sidewall extending upwardly from an inner periphery of the connecting wall up to near an inner periphery of the first air inlet.

6. The centrifugal fan as described in claim 5, wherein a diameter of the first air inlet of the top cover substantially equals to that of the second air inlet of the bottom base, and the connecting wall of the blade ring is located just under the top cover.

7. The centrifugal fan as described in claim 1, wherein a vertical height of the at least one cylindrical wall varies between 1.5 millimeters and 2.2 millimeters.

8. The centrifugal fan as described in claim 1, wherein each of the blades comprises a first blade portion connected with the hub and a second blade portion extending from a distal end of the first blade portion, and a vertical height of the second blade portion is larger than that of the first blade portion.

9. The centrifugal fan as described in claim 8, wherein the at least one cylindrical wall is located at a position corresponding to a joint between the first blade portion and the second blade portion, and the second blade portion is received between the at least one cylindrical wall and the side wall of the fan frame.

10. A centrifugal fan comprising:

a bottom base defining an air inlet at a central portion thereof;

a top cover being located opposite to the bottom base;

a side wall interconnecting the bottom base with the top cover and defining an air outlet therein, wherein the air inlet and the air outlet are perpendicular to each other;

a rotor received in a space defined by the bottom base, the top cover and the side wall, wherein when the rotor rotates, ambient air is inhaled from the air inlet into said space and leaves said space from the air outlet; and a cylindrical wall extending from an inner periphery of the air inlet into said space adapted for guiding the ambient air from the air inlet into said space and blocking interior air in said space from flowing back towards the air inlet;

wherein the rotor includes a plurality of blades and a blade ring attached to a top of the blades, the blade ring includes a connecting wall received in an air inlet defined in the top cover, and a cylindrical sidewall extending downwardly from an outer periphery of the connecting wall and neighboring an inner periphery of the air inlet of the top cover, a top surface of the connecting wall of the blade ring being coplanar with a top surface of the top cover, said sidewall being adapted for guiding the ambient air from the air inlet of the top cover into said space and blocking the interior air in said space from flowing back towards the air inlet of the top cover.

11. The centrifugal fan as described in claim 10, wherein a diameter of the air inlet of the top cover is larger than that of the air inlet of the bottom base.

12. The centrifugal fan as described in claim 10, wherein the rotor includes a plurality of blades and a blade ring attached to a top of the blades, the blade ring includes a connecting wall and a cylindrical sidewall extending upwardly from an inner periphery of the connecting wall into an air inlet defined in the top cover, the cylindrical sidewall neighboring an inner periphery of the air inlet of the top cover adapted for guiding the ambient air from the air inlet of the top cover into said space and blocking the interior air in said space from flowing back towards the air inlet of the top cover.

13. The centrifugal fan as described in claim 12, wherein a diameter of the air inlet of the top cover substantially equals to a diameter of the air inlet of the bottom base, a top surface of the cylindrical sidewall of the blade ring being coplanar with a top surface of the top cover.

14. The centrifugal fan as described in claim 10, wherein the top cover defines an air inlet at a central portion thereof, another cylindrical wall extends from an inner periphery of the air inlet of the top cover into said space adapted for guiding the ambient air from the air inlet of the top cover into said space and blocking the interior air in said space from flowing back towards the air inlet of the top cover.

15. The centrifugal fan as described in claim 10, wherein the rotor includes a plurality of blades, and each of the blades includes a first blade portion and a second blade portion extending outwardly from the first blade portion and having a larger height than the first blade portion.

16. The centrifugal fan as described in claim 15, wherein the cylindrical wall is located between the first blade portion and the second blade portion, and a bottom portion of the second blade portion is received between the side wall and the cylindrical wall.

* * * * *